United States Patent [19]

Anastasia et al.

[11] Patent Number: 4,744,563

[45] Date of Patent: May 17, 1988

[54] WAIST-MOUNTED ROLLING BALL GAME

[76] Inventors: Angelo Anastasia, 222 Edinburgh Ave., Monterey, Calif. 93940; George Spector, 233 Broadway, RM 3815, New York, N.Y. 10007

[21] Appl. No.: 891,284

[22] Filed: Jul. 31, 1986

[51] Int. Cl.[4] ..... A63B 67/14

[52] U.S. Cl. ..... 273/116; 273/DIG. 19

[58] Field of Search ..... 273/DIG. 19, 116, 109, 273/110, 123 R

[56] References Cited

U.S. PATENT DOCUMENTS

| | | | |
|---|---|---|---|
| 2,536,393 | 1/1951 | Regenold | 273/116 |
| 3,200,536 | 8/1965 | Petitto | 273/DIG. 19 |
| 3,563,550 | 2/1971 | Saunder | 273/DIG. 19 |
| 3,820,783 | 6/1974 | Caveness | 273/DIG. 19 |
| 3,829,088 | 8/1974 | Pahlas | 273/116 |
| 4,121,822 | 10/1978 | DiSabatino et al. | 273/DIG. 19 |

FOREIGN PATENT DOCUMENTS

| | | | |
|---|---|---|---|
| 3419005 | 10/1985 | Fed. Rep. of Germany | 273/DIG. 19 |
| 0755436 | 11/1933 | France | 273/116 |

*Primary Examiner*—Richard C. Pinkham
*Assistant Examiner*—Gary Jackson

[57] ABSTRACT

A rock and roll game is provided and consists of a ball disposed within a container for rolling in a reversing curved track so that a person can manipulate the container to bring the ball from a starting end to a finishing end without going into any traps to complete the game. The container can be hooked onto a belt of the person so that the person can manipulate the container by moving hips in any direction. The angle of the container relative to the belt can be adjusted.

2 Claims, 1 Drawing Sheet

WAIST-MOUNTED ROLLING BALL GAME

BACKGROUND OF THE INVENTION

The instant invention relates generally to games and more specifically it relates to a rock and roll game.

Numerous games have been provided in prior art that are adapted to cause objects to roll along a given path. For example, U.S. Pat. Nos. 3,080,675; 3,399,894 and 3,768,810 all are illustrative of such prior art. While these units may be suitable for the particular purpose to which they address, they would not be as suitable for the purposes of the present invention as heretofore described.

SUMMARY OF THE INVENTION

A primary object of the present invention is to provide a rock and roll game that will overcome the shortcomings of the prior art devices.

Another object is to provide a rock and roll game that is manipulated by a person to move a ball down a track without falling into traps along the way.

An additional object is to provide a rock and roll game that is attached to the belt of the person so that the hips will do the manipulating.

A further object is to provide a rock and roll game that is simple and easy to use.

A still further object is to provide a rock and roll game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
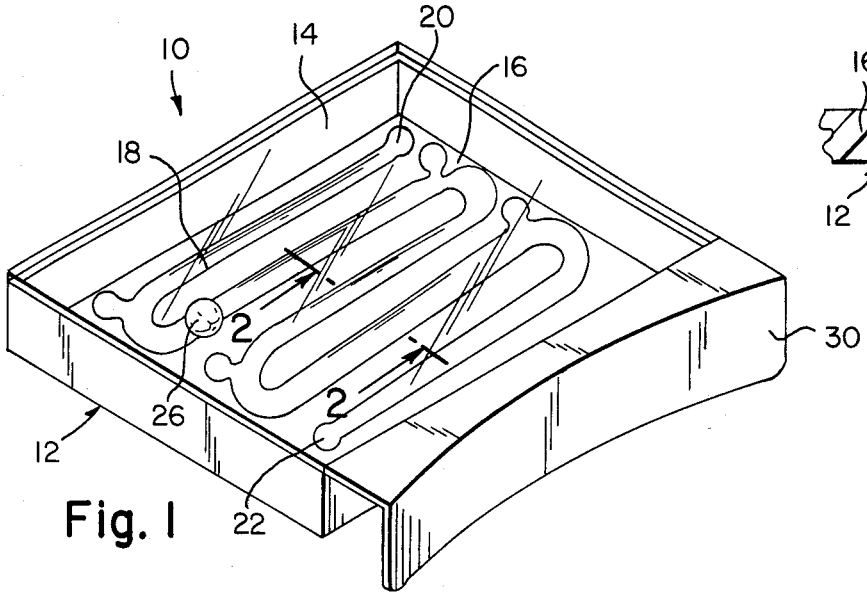
FIG. 1 is a perspective view of the invention.
Figure 2:
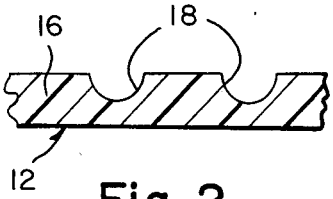
FIG. 2 is an enlarged cross sectional view taken along line 2—2 in FIG. 1 showing the track therein.
Figure 3:
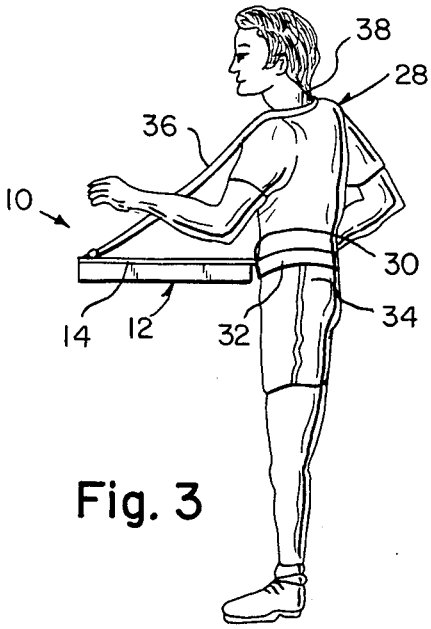
FIG. 3 is a side view of a modification showing the invention connected to belt of a person with a strap around the neck.

Turning now descriptively to the drawings, in which similar reference characters denote similar elements throughout the several views, FIGS. 1 through 3 illustrates a rock and roll game 10 consisting of a hollow container 12 that has a transparent top 14 and a floor 16. A track 18 (see FIG. 2) is formed within the floor 16 of the container. The track 18 is generally a reversing curve with a starting end 20 and a finishing end 22. The track 18 has a plurality of traps 24 therealong. A ball 26 is dispoed within the container 12 for rolling in the track 18.

A person 28 can manipulate the container 12 to bring the ball 26 from the starting end 20 to the finishing end 22 avoiding the traps 24 to complete the game 10. A holder 30 extends rearwardly from the top 14 of the container 12 at the finishing end 22 of the track 18 for hooking onto a belt 32 of the person 28. The person can manipulate the container by moving hips 34 in any direction. FIG. 3 shows a strap 36 extending upwardly from the top 14 of the container 12 at the starting end 20 of the track 18 and around neck 38 of the person 28. The strap 36 will stabilize the container 12 when being manipulated by the hips 34.

Figure 4:
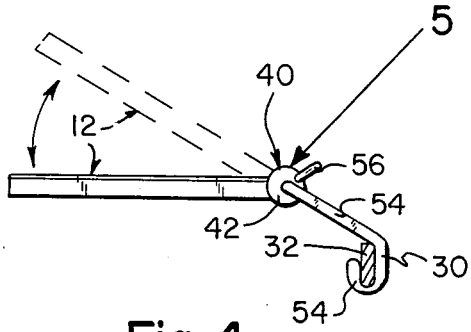
FIG. 4 is a side view of another modification with an adjustment device to change angle of the game when worn on the belt.
Figure 5:
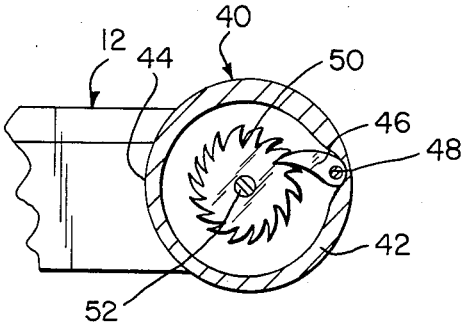
FIG. 5 is an enlarged cross sectional view of the adjustment device as indicated by arrow 5 in FIG. 4.

FIGS. 4 and 5 show an adjustment device 40 between the container 12 and the holder 30 to change angle of the container 12 with respect to the holder 30, when the holder is hooked onto the belt 32 of the person. The adjustment device 40 consists of a cylindrical housing 42 mounted to rear side 44 of the container 12. A paul 46 is pivotly mounted and spring biased inwardly to the housing 42 at 48. A ratchet 50 that has a shaft 52 is rotatably mounted through the housing 42 in which the ratchet 50 coacts with the paul 46. A pair of extension arms 54 extend downwardly angular from the external ends of the shaft 52 to the holder 30. A release lever 56 is operatively connected to the paul 46 at 48. The housing 42 and the paul 46 can travel around the ratched 50 in one direction and be locked into position by the paul 46 until the release lever 56 releases the paul 46 from the ratchet 50 to reset the angle of the container 12. The holder 30 can have a lower hook 54 to better grip the belt 32 and keep the holder stationary when changing the angle of the container 12.

While certain novel features of this invention have been shown and described and are pointed out in the annexted claims, it will be understood that various omissions, substitutions and changes in the forms and details of the device illustrated and in its operation can be made by those skilled in the art without departing from the spirit of the invention.

What is claimed is:

1. A rock and roll game comprising:

(a) a hollow container having a transparent top and a floor;

(b) a track formed within said floor;

(c) a ball disposed within said container for rolling in said track;

(d) a holder extending rearwardly from said container adapted for hooking onto a belt of said person so that said person can manipulate said container by body movement;

(e) an adjustment device between said container and said holder to change the angle of said container with respect to said holder wherein said adjustment device comprises:

(f) a cylindrical housing mounted to rear side of said container;

(g) a pawl pivotly mounted and spring biased inwardly to said housing;

(h) a ratchet having a shaft rotatably mounted through said housing, said ratchet coacting with said pawl;

(i) a pair of extension arms each downwardly angular extend from one external end of said shaft to said holder; and (j) a release lever operatively connected to said pawl whereby said housing and said pawl can travel around said ratchet in one direction and be locked into position by said pawl until said release lever releases said pawl from said ratchet to reset the angle of the container.

2. A rock and roll game as in claim 1, including a strap connected to the container outward of the person, said strap being adapted to be looped around a person's neck to provide support for the container at any angle of adjustment.

* * * * *